US007019767B2

(12) United States Patent
Ohba et al.

(10) Patent No.: US 7,019,767 B2
(45) Date of Patent: Mar. 28, 2006

(54) IMAGE FORMING APPARATUS

(75) Inventors: Tadashi Ohba, Kyoto (JP); Jun Nakai, Kyoto (JP)

(73) Assignee: Kyocera Corporation, Kyoto (JP)

( * ) Notice: Subject to any disclaimer, the term of this patent is extended or adjusted under 35 U.S.C. 154(b) by 268 days.

(21) Appl. No.: 10/721,716

(22) Filed: Nov. 25, 2003

(65) Prior Publication Data

US 2004/0135877 A1 Jul. 15, 2004

(30) Foreign Application Priority Data

Nov. 25, 2002 (JP) ..... 2002-341549

(51) Int. Cl.
*B41J 27/00* (2006.01)

(52) U.S. Cl. ..... 347/244; 347/258

(58) Field of Classification Search ..... 347/134, 347/236, 240, 244, 246, 251, 258; 359/625–626, 359/652; 382/255; 356/4.04
See application file for complete search history.

(56) References Cited

U.S. PATENT DOCUMENTS 5,148,502 A * 9/1992 Tsujiuchi et al. ..... 382/255

5,978,146 A * 11/1999 Kittaka et al. ..... 359/652

FOREIGN PATENT DOCUMENTS

JP 2002-055498 2/2002

* cited by examiner

*Primary Examiner*—Hai Pham
(74) *Attorney, Agent, or Firm*—Schulte Roth & Zabel LLP; Joel E. Lutzker; John C. Garces

(57) ABSTRACT

When intending gradational representation of each of the dots composing the image by changing the amount of light emission of each of the dots composing an image by changing the amount of light emission of said light emitting diode, the magnitude of each of the dots becomes reduced resulting in unstable reproducibility of dot. This causes damage in the regularity of the distribution of image density and the graininess of the printed image increases. The invention aims to provide an image forming apparatus which can decrease granularity (graininess) by simple and inexpensive construction by defocusing on the photo conductor the light ray passing through the lens array of the exposing device in the image forming apparatus in accordance with the percentage of the luminous dots changed in the amount of light emission among the dots composing the image. This prevents the occurrence of irregular density distribution in the latent image on the photo conductor drum. As a result, the graininess of the printed image is decreased.

15 Claims, 3 Drawing Sheets

IMAGE FORMING APPARATUS

CROSS-REFERENCE TO RELATED APPLICATIONS

This application claims all rights of priority to Japanese Patent Application No. 2002-341549 filed on Nov. 25, 2002, (pending).

BACKGROUND OF THE INVENTION

The present invention relates to an image forming apparatus used in a copying machine, printer, facsimile machine, and combinations of these machines. Specifically, an image forming apparatus is provided which uses an exposing device composed of light emitting diodes arranged in the axial direction of a photo conductor and a lens array provided in correspondence to said light emitting diodes and performs gradational representation of each of the dots composing the image by varying the amount of light emission of said light emitting diodes. The granularity (graininess) of the printed image is improved and the roughness and irregularity in density in the printed image, or rough image, is prevented.

DESCRIPTION OF THE RELATED ART

Recently, there has been a demand for personalized small-sized, inexpensive image forming apparatuses used in copying machines, printers, facsimile machines, and combinations of these machines. The present invention provides exposing devices with light emitting diodes (hereafter referred to as LEDs) arranged in arrays instead of exposing devices with laser diodes and polygon mirrors as known in the prior art. This is because the exposing device using LEDs can be composed in smaller size compared with using laser diodes and polygon mirrors, and furthermore can be composed into a simple and inexpensive construction without the necessity of using precision moving elements such as an expensive polygon mirror, motor, and complicated control circuit.

Also, in an electrophotographic image forming machine, copying with finer resolutions of 600 dpi, 1200 dpi, etc. is done for higher image quality. At the same time, varying of light emitting period is done in order to obtain multi-step gradational representation of each of the dots composing the image, in which, for example, each picture element itself is divided in 16 matrixes, each matrix corresponding to a dot, and each dot is varied in 16 steps of magnitude to produce 256 levels of halftone. With an exposing device using light emitting diodes, the light emitting period can be easily controlled, so that multi-step gradational representation can be easily done. However, since the size of a picture element is about 40 um square for a resolution of 600 dpi, or about 20 μm square for a resolution of 1200 dpi, if the light emitting period of each dot is to be controlled in order to produce each dot itself with 16-step gradation as mentioned above, the magnitude of the dot becomes smaller.

If the magnitude of the dot is reduced, the reproducibility of the dot becomes unstable, and some dots may not be reproduced. The dot of reduced light emitting period is influenced by the rise characteristic of light emission, and the reproducibility is different depending on the variation in the sensitivity of the photo conductor drum. Irregularity occurs in the density distribution in the latent image on the photo conductor drum, and in the amount of toner developed thereon damaging the regular distribution of image density on the drum. As a result, the granularity (graininess) of the printed image tends to increase. This occurs particularly when the exposing device accurately focuses the light ray emitted from the diode on the photo conductor. Although it might be thought that the reproducibility of image is improved by tight-focusing, the regularity in image density is damaged due to the reason mentioned above when the magnitude of dot is considerably reduced, and the graininess of the printed image increases.

An image forming apparatus to deal with the increase of graininess like this is disclosed in Japanese patent Laid-Open publication No. 2002-55498 (hereafter referred to as patent literature 1). The apparatus disclosed in the patent literature 1 relates to an image forming apparatus, in which the deterioration in image, such as the occurrence of increased graininess, caused by the deviation of image focusing location in the exposure system used in the electrophotographic process, by the variation in image density, and by the decrease in the reproducibility of thin lines and letters, are prevented. A sample halftone image is formed in the printer part, and the image is read to determine the value of granularity (graininess) from the brightness of the image signal by the fast Fourier transform method. The deviation of the focusing location of image is determined based on the value of granularity. The image processing method for generating the image data to be supplied to the printer part is determined in accordance with the deviation. When the deviation is between ±50~150 μm, flattening type dither method is used. When the deviation exceeds ±150 μm, the amount of light emission is increased. Thus, the amount of light emission in electrophotographic process is adjusted based on the deviation.

However, the apparatus disclosed in the patent literature 1 must include a means for determine the graininess as a numerical value by forming a sample halftone image in the printer part, a means for determining the deviation of the focusing location of image in the exposure system based on the determined numerical value of granularity, a means for deciding the method of compensation in accordance with the amount of the deviation, and an image processing means for compensating for the deviation. Therefore, the apparatus becomes inevitably complicated and expensive.

SUMMARY OF THE INVENTION

The present invention aims to provide an image forming apparatus which can decrease by simple and inexpensive construction the granularity (graininess) of the printed image caused by the irregularity in image density induced by the unstable reproducibility of small dots.

The present invention provides an image forming apparatus having an exposing device which images the light ray from the light emitting diode array on a photo conductor through a lens array. The gradational representation of each of the dots composing the image is performed by changing the amount of the light emission of the dots composing the image. The exposing device is provided with a defocusing means for imaging the light ray out of focus on a photo conductor when the percentage of luminous dots changed in the amount of light emission among all of the dots composing the image to be formed.

When the magnitude of a dot is reduced in the process of performing the gradational representation of image as mentioned before, the reproducibility of the dot becomes unstable, and some dots may not be reproduced. That is, the dot of which the light emitting period is decreased is influenced by the rise characteristic of light emission, Differences in the reproducibility of a dot may also depend on variations in the sensitivity of the photo conductor. Irregularity occurs in the density distribution in the latent image on the photo conductor drum, and in the amount of toner developed thereon damaging the regular distribution of toner image density on the drum. As a result, the granularity (graininess) of the printed image tends to increase. This occurs particularly when the exposing device accurately focuses the light ray emitted from the diode on the photo conductor. Although it might be thought that the reproducibility of image is improved by tight-focusing, the regularity in image density is damaged due to the reason mentioned above and graininess increases. In the present invention, a defocusing means is provided to defocus the exposing device to bring each dot out-of-focus when the percentage of luminous dots changed in the amount of light emission is larger than a certain value to prevent irregular density distribution in the latent image on the photo conductor drum. The toner image is then developed on the drum without irregularity in its concentration and the graininess of the printed image is decreased. An image forming apparatus can be provided with a reduction in the graininess caused by the irregularity of image density distribution arising from the unstable or irregular reproducibility of a dot having a reduced magnitude.

When the percentage of the number of the luminous dots changed in the amount of light emission among the dots composing the image is 60 or larger, the occurrence of irregular density distribution in the latent image on the photo conductor is prevented and the toner image is developed on the drum without irregularity in its concentration. By this, an image forming apparatus, with which the graininess caused by the irregularity in the image density distribution owing to the unstable reproducibility of dot because of reduced magnitude of the dot is decreased, can be provided.

Further, the present invention provides an image forming apparatus having a photo conductor or conductors corresponding to a plurality of colors or to each of a plurality of colors, and an exposing device or devices corresponding to the photo conductor or to each of the photo conductors. The device or devices imaging the light ray or rays from the light emitting diode array or arrays on the photo conductor conductors through a lens array or arrays, gradational representation of each of the dots composing the image being performed by changing the amount of the light emission of the light emitting diode. The exposing device or devices each is provided with a means of defocusing the image on a photo conductor with the light ray corresponding to the color of high brightness among a plurality of colors.

When used in mono-color, a color of high reflection brightness hardly induces poor image quality such as "gradation jump". Therefore, by providing the defocusing means to bring the light ray corresponding to the color of high reflection brightness out-of-focus, the minute portions of the image (improvement in granularity) can be possible when the color is used together with other colors.

If yellow is brought out-of-focus when it is imaged on the photo conductor, the representation of minute portions of the image can be possible and improvement in granularity is possible when it is used together with other colors because yellow is the highest in reflection brightness among monocolors and it hardly induces poor image quality such as "gradation jump" visually recognizable when used in monocolor.

The defocusing means can be a means to shift the exposing device, means to shift the light emitting diode array or means to shift the lens array. The exposing device can be defocused by any such defocusing means.

The exposing device can be used among a plurality of the image forming apparatuses, and by making the exposing device adjusted by the defocusing means in each of the image forming apparatuses, it can be used as an image forming apparatus used for different percentages of the number of the luminous dot changed in the amount of light emission.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
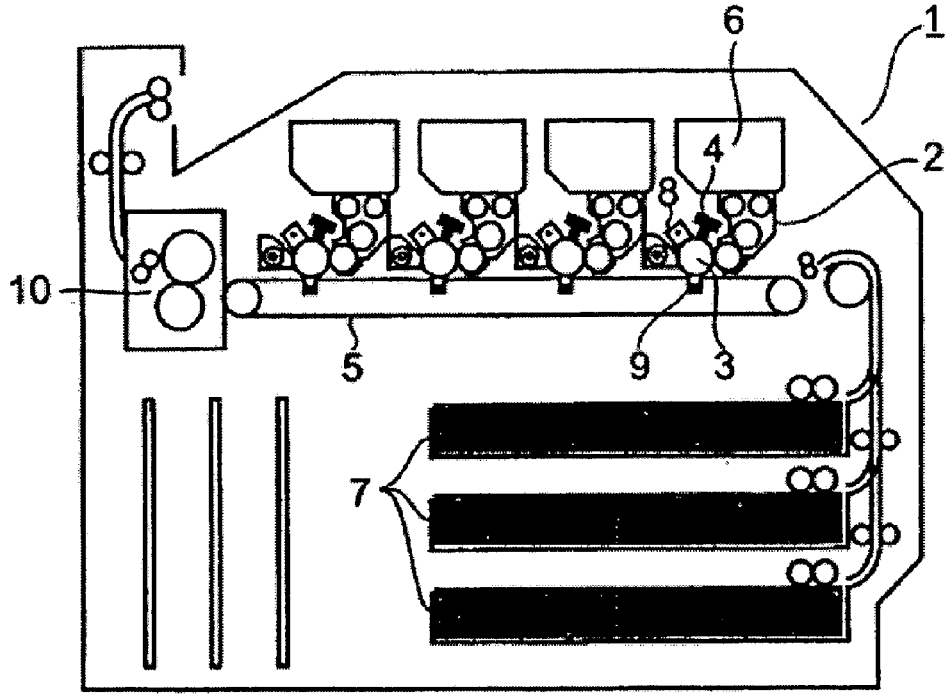
FIG. 1 is a schematic drawing of the configuration of the color image forming apparatus for implementing the present invention.
Figure 2:
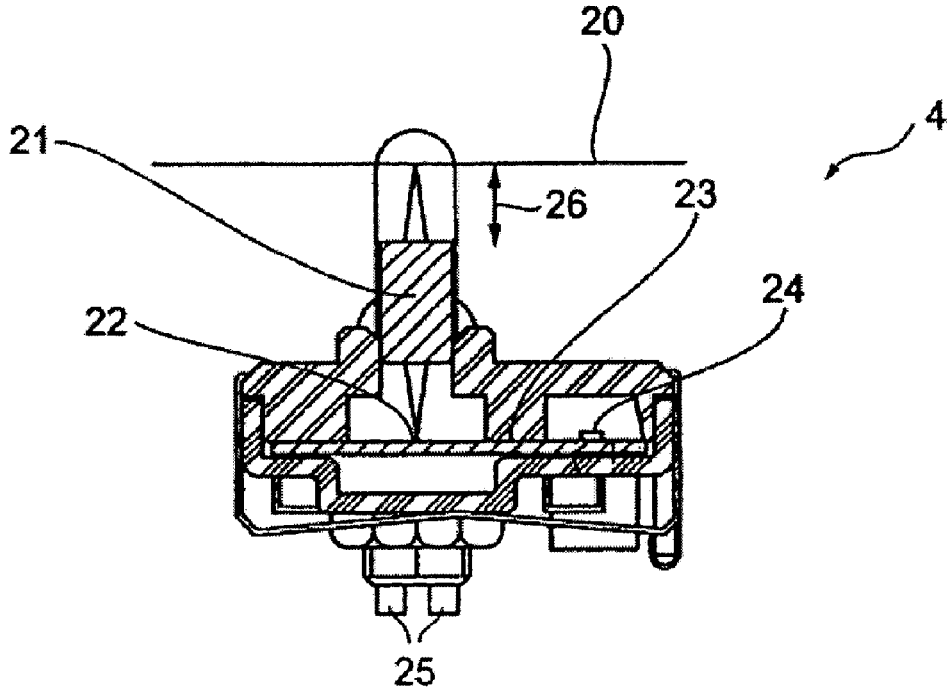
FIG. 2 is a schematic illustration of the exposing device used in the present invention.

Referring to FIG. 1, reference numeral 1 is a color image forming apparatus, 2 is a developing device, 3 is a photo conductor, 4 is an exposing device, 5 is a transfer belt, 6 is a developer container, 7 is a paper feeder cassette accommodating recording mediums, 8 is a charging device for electrically charging the photo conductor, 9 is a transfer device for transferring the toner image on the photo conductor onto the recording device by applying transfer bias voltage, and 10 is a fixing device for fixing the toner image transferred to the recording medium. Among them, each of the developing devices 2, photo conductors 3, exposing devices 4, developer containers 6, charging devices 8 for electrically charging the photo conductors, and the transfer devices 9 for transferring the toner image on the photo conductors by applying transfer bias voltage, is provided as a process unit corresponding to each color of yellow, cyan, magenta, black, etc. used in the color image forming apparatus. Referring to FIG. 2, 4 is an exposing device using light emitting diodes, 20 is the imaging surface of the photo conductor, 21 is a fiber lens array, 22 is a light emitting diode array on the circuit board 22, 24 is a driver IC of the light emitting diode array, and 25 is an adjusting pin for adjusting the focusing location of the exposing device 4.

One embodiment of the invention is the color image forming apparatus. The developer is supplied from the developer container 6 to the developing device 2 in each of the process units corresponding to each color of yellow, cyan, magenta, and black. The toner in each developer is electrically charged by agitation. Upon receiving from a control circuit the print signal based on the image signal corresponding to each color, first the photo conductor 3 of each process unit is electrically charged by the charging device 8, then the image signal is sent to the exposing device 4 of each process unit to form the latent image corresponding to each color on each photo conductor 3. Each of the latent images is developed by each developing device 2 to form a toner image.

When each toner image has been formed on each photo conductor 3, a recording medium is taken out from the paper feeder cassette 7 and transferred on the transfer belt so that the timing that the recording medium comes to the image transfer position matches with the timing that the image comes to the image transfer position. Transfer bias voltage is applied by the transfer device 9 provided at the transfer position of each color to transfer each toner image on the recording medium. The toner image of each color is transferred sequentially to the recording medium, and when the recording medium comes to the fixing device the image is fixed and discharged.

The exposing device 4 is composed, as shown in FIG. 2, so that the light emitted from the light emitting diodes driven by the driver IC 24 formed on the circuit board 23 is imaged through the fiber lens array 21 on the imaging surface of the photo conductor 20. The optical distance from the light emitting array 22 to the fiber lens array 21 is normally the same as that from the fiber lens array 21 to the imaging surface of the photo conductor 20, and the degree of focusing on the imaging surface of the photo conductor 20 can be adjusted by shifting the exposing device 4 in the directions shown by double arrow 26 through rotating the adjusting pin 25.

In the image forming apparatus, each of the picture elements of the image is divided into, for example, 16 square cells (i.e., 4 by 4), each cell being allotted with a dot. The magnitude of each dot is varied in 16 steps of 0/15–15/15 by varying the amount of light emission of the exposing device as mentioned so that a gradational representation of image is possible. By this treatment, each picture element consisting of, for example 16 cells can produce different color varieties equal to the square of the number of cells. For example, 256-level gray scale, and screen tint, etc. are possible. When each dot itself is represented with a step gradation, for example one of 16 possible gradations, by controlling the light emitting period of each dot, the dot magnitude of a small amount of light emission becomes even smaller.

Therefore, when a very small dot such as the dot of the light exposure of 1/15, for example, exists separately, the reproducibility of the dot is unstable because of the influence of the rise characteristic of light emission of the light emitting diode array composing the exposing device 4 and the variation in sensitivity of the photo conductor 3, and some dots may not be reproduced. Irregularity occurs in the density distribution in the latent image on the photo conductor 3, and in the amount of toner developed thereon damaging the regular distribution of toner image density on the drum. As a result, the granularity (graininess) of the printed image increases. This occurs particularly when the light emitted from the exposing device 4 accurately focuses the light ray emitted from the diode on the photo conductor 3. Although it might be thought that the reproducibility of image is improved by tight-focusing, the regularity of image density is damaged and graininess is increased when the magnitude of dot is considerably reduced.

Figure 3:
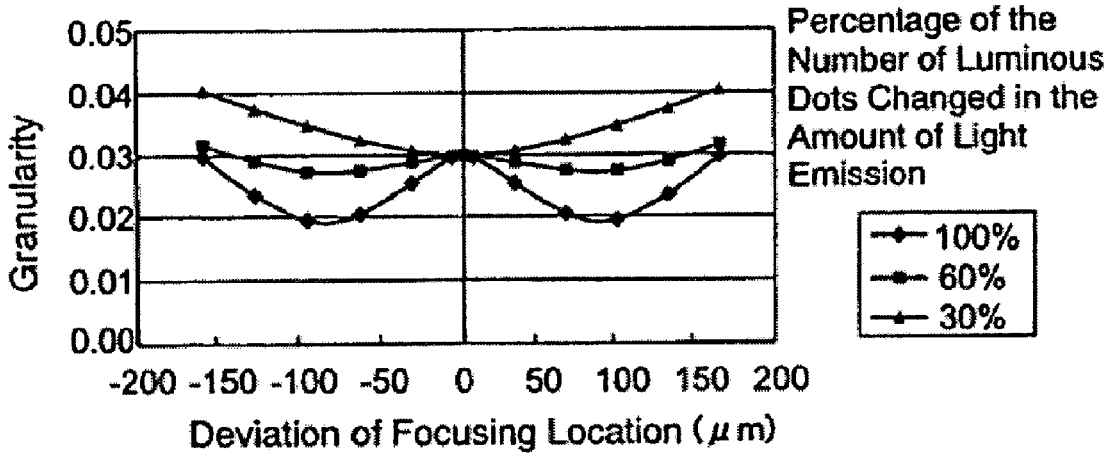
FIG. 3 is a graph showing the relation between the accuracy of focusing and granularity with the percentage of the number of the dots changed in the amount of light emissions.
Figure 5A:
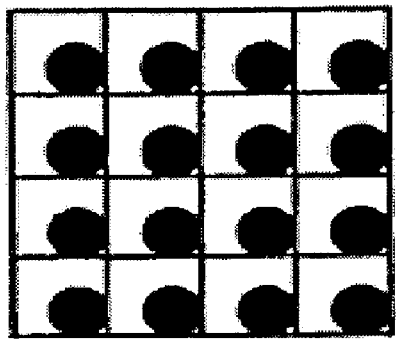
FIG. 5A is a conceptual illustration when the amount of light emission of the dots composing the image is changed for representing the image with gradation.
Figure 5B:
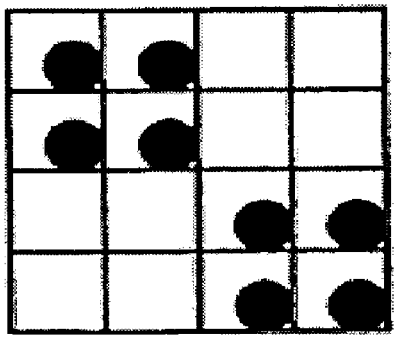
FIG. 5B is a conceptual illustration when the number of the dots is changed.

FIG. 3 shows the relation between the degree of focusing and graininess. In FIG. 3, the abscissa represents the amount of out-of-focus on the imaging surface 20 of the photo conductor in μm in the exposing device 4 shown in FIG. 2, and the ordinate shows the granularity of the printed image. That the percentage of the luminous dots changed in its light emitting amount is 100 means that, for example, dots of magnitude of 7/15 are allotted to all of 16 cells as shown in FIG. 5A. That the percentage is 50 means that dots of magnitude of 7/15 are allotted to 8 cells among 16 cells, similarly percentage of 30 means that dots of magnitude of 7/15 are allotted to 5 cells among 16 cells. The line of 60% in FIG. 3 shows the case dots of magnitude of 7/15 are allotted to 10 cells among 16 cells. The granularity shown in FIG. 3 is determined by the method in which first a sample image of halftone is formed, the image signal of the sample image is read, and the graininess is grasped as a numerical value from the brightness of the image signal by use of fast Fourier transform as described in the patent literature 1.

It is preferred that the distance from the light emitting point of the light emitting diode 22 to the imaging surface 20 of the photo conductor is 9 to 18 mm, and the distance from the lens array 21 to the imaging surface 20 is 2.4 to 5.0 mm. The graph showing the relation between the accuracy of focusing and granularity shown as FIG. 3 is the result of measurement, for example, the distance from the light emitting point of the light emitting diode 22 to the imaging surface 20 was 15.1 mm and the distance from the lens array 21 to the imaging surface 20 was 4.1 mm.

When the percentage of the luminous dots changed in the amount of light emission is between 60~100, the granularity is at minimum when the defocus is about 100 μm. When the percentage is 30, the granularity simply increases as the amount of defocus increases. This is because each of the dots become defocused uniformly by an amount of about 100 μm. As a result the occurrence of irregularity of density in the latent image on the photo conductor drum is prevented resulting in regular distribution of toner image density on the drum. Also, the granularity (graininess) of the printed image decreases. When defocused largely over 100 μm, the latent image is not formed, and granularity increases. When the percentage is as small as 30, the percentage of isolated dots increases and banding, or irregularity of strike pattern, occurs , so that graininess deteriorates as the defocusing is increased.

In the present invention, when the image forming apparatus is assembled, the percentage of the number of the luminous dots changed in the amount of light emission is tracked so that when the percentage is 60 or larger, the adjusting pin 25 of the exposing device 4 shown in FIG. 2 is adjusted to defocus the imaging of dot on the imaging surface 20 of the photo conductor. For example, if the distance from the light emitting point of the light emitting diode array 22 to the imaging surface 20 of the photo conductor is 15.1 mm and the distance from the lens array to the imaging surface 20 is 4.1 mm as mentioned above, by defocusing the imaging of dot on the imaging surface 20 by about 100 μm, the occurrence of irregularity of density in the latent image on the photo conductor drum is prevented resulting in regular distribution of toner image density on the drum. As a result, the granularity (graininess) of the printed image decreases. Accordingly, an image forming apparatus, with which the graininess of the printed image caused by the irregularity in print density induced by the unstableness of dot reproducibility can be provided.

Although, in the embodiment, it is explained that the adjusting pin 25 is used as a defocusing means and the exposing device 4 is shifted in the direction to or from the imaging surface 20 of the photo conductor, any other composition of defocusing means is satisfactory as far as the degree of defocusing of the light beam emitted from the light emitting diode array 22 can be adjusted. For example, a means to shift only the circuit board 23 on which the light emitting diode array 22 is provided or a means to shift only the fiber lens array 21 or further a means to shift the photo conductor is acceptable for a defocusing means.

Figure 4:
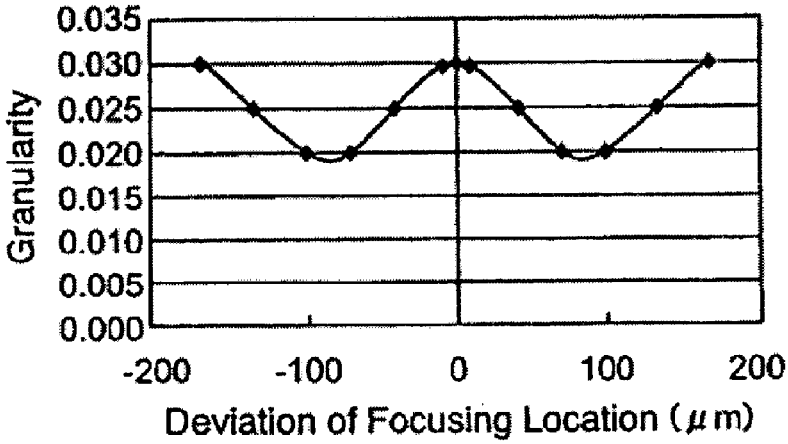
FIG. 4 is a graph showing the relation between the accuracy of focus location when yellow and magenta is mixed and the granularity of printed image.

FIG. 4 is a graph showing the relation between the accuracy of focusing and granularity when yellow and magenta are mixed and measured from the light emitting point of the light emitting diode array 22 to the imaging surface 20 of the photo conductor was 15.1 mm and the distance from the lens array to the imaging surface 20 was 4.1 mm. Yellow is high in reflection brightness, and poor image quality such as "gradation jump" is hardly recognizable when used in mono-color. So when yellow is mixed with other colors, the percentage of the luminous dots changed in the amount of light emission increases. Therefore, granularity is at minimum when the amount of defocusing is near about ±100 μm. Similarly the percentage of the luminous dots changed in the amount of light emission in FIG. 3 is 100.

In the present invention, defocusing is done in the exposing device 4 corresponding to yellow in the image forming apparatus 1 when the percentage of the luminous dots changed in the amount of light emission, which luminous dots compose the image data to be treated, is above 60. The amount of the defocusing is determined to be about ±100 μm.

By determining when yellow is mixed with other colors, the representation of minute portions of the image is possible by defocusing, because yellow is high in reflection brightness and poor image quality, such as "gradation jump", is hardly recognizable when used in mono-color. When the percentage of the dots not emitting light (dots of which the amount of light emission is 0) is 40 or lower, that is, when the percentage of the number of the dots actually existing as dots is above 60, the occurrence of irregularity of density in the latent image on the photo conductor drum is prevented resulting in regular distribution of toner image density on the drum. Therefore, an improved image forming apparatus can be provided by defocusing when the percentage of the dots not emitting light is 40 or lower.

Although the embodiment has each photo conductor 3 corresponding to each of the colors, similar effect can be obtained by providing a photo conductor for a total color or a photo conductor corresponds to a plurality of colors.

A further embodiment is the case where the defocusing is adjusted when the exposing device is assembled to the image forming apparatus. By making it possible to adjust defocusing when assembling, a common exposing device 4 can be used for an apparatus which is the percentage of the luminous dots changed in the amount of light emission is different, allowing for the use of common parts. In yet another embodiment, the defocusing means is accessible to the use such that the user can adjust the defocusing through the defocusing means while operating the apparatus. Specifically, the desired printing result can be obtained by making it possible to manipulate the defocusing means by a button provided to the housing of the apparatus or an external device connected to the apparatus. Alternatively, it would be possible to automatically adjust the defocusing in accordance with the deviation in the characteristic of the exposing device. For example, in accordance with deviation caused by the warping, etc. of the circuit board arising from the prolonged use of the exposing device 4, or in accordance with the environmental conditions obtained from the temperature sensor, humidity sensor, etc.

According to the present invention, the defocusing means is provided, and the exposing device is defocused to bring each dot out-of-focus when the percentage of the luminous dots changed in the amount of light emission is larger than a certain value in order to prevent the occurrence of irregular density distribution in the latent image on the photo conductor drum. The toner image is developed on the drum without irregularity in its concentration and the graininess of the printed image is decreased. An image forming apparatus, with which the graininess caused by the irregularity of the image density distribution owing to the unstable reproducibility of dot because of reduced magnitude of the dot is decreased, can be provided.

Further, according to the present invention, by providing a defocusing means and defocusing the color of high reflection brightness, the representation of minute portions of the image (improvement in granularity) is possible when the color is used together with other colors because with colors of high reflection brightness, poor image quality such as "gradation jump" is hardly recognizable when it is used in mono-color.

What is claimed is:

1. An image forming apparatus comprising:

a photo conductor;

an exposing device having a light emitting diode array for emitting light and a lens array through which the light passes for forming an image composed of a plurality of dots on said photo conductor, wherein the amount of light emission of said light emitting diode is varied for a gradational representation of the each of the plurality of dots; and said exposing device further comprising defocusing means for imaging the light beam out of focus on said photo conductor when a percentage of a number of luminous dots changed in the amount of light emission among all of the dots composing said image is a predetermined value or larger.

2. The image forming apparatus according to claim 1, wherein the defocusing is effectuated when the percentage of the luminous dots changed in the amount of light emission is 60 or larger.

3. The image forming apparatus according to claim 1, wherein the defocusing means can shift the exposing device to defocus the image.

4. The image forming apparatus according to claim 1, wherein the defocusing means can shift the light emitting diode array to defocus the image.

5. The image forming apparatus according to claim 1, wherein the defocusing means can shift the lens array to defocus the image.

6. The image forming apparatus according to claim 1, wherein the exposing device is used with a plurality of image forming apparatuses and each exposing device includes a defocusing means that may be defocused by one of shifting the exposing device, shifting the light emitting diode array to defocus the image and shifting the lens array to defocus the image.

7. An image forming apparatus comprising:

a photo conductor corresponding to a plurality of colors;

an exposing device having a light emitting diode array for emitting light a lens array through which the light passes to form an image composed of a plurality of dots on said photo conductor, wherein the amount of light emission of said light emitting diode is varied for a gradational representation of the each of said plurality of dots; and said exposing device further comprising defocusing means for imaging out of focus on said photo conductor the light corresponding to the color of high brightness among said plurality of colors.

8. The image forming apparatus according to claim 7, wherein the defocusing means can shift the exposing device to defocus the image.

9. The image forming apparatus according to claim 7, wherein the defocusing means can shift the light emitting diode array to defocus the image.

10. The image forming apparatus according to claim 7, wherein the defocusing means can shift the lens array to defocus the image.

11. The image forming apparatus according to claim 7, wherein the exposing device is used with a plurality of image forming apparatuses and each exposing device includes a defocusing means that may be defocused by one of shifting the exposing device, shifting the light emitting diode array to defocus the image and shifting the lens array to defocus the image.

12. An image forming apparatus comprising:

a plurality of photo conductors corresponding to a plurality of colors;

a plurality of exposing devices, each having a light emitting diode array for emitting light a lens array through which the light passes to form an image composed of a plurality of dots on said photo conductor, wherein the amount of light emission of said light emitting diode is varied for a gradational representation of the each of said plurality of dots; and each of said plurality of exposing devices further comprising defocusing means for imaging out of focus on a photo conductor of said plurality of photo conductors the light corresponding to the color of high brightness among said plurality of colors.

13. The image forming apparatus according to claim 12, wherein for at least one of said plurality of exposing devices said defocusing means can shift said at least one exposing device to defocus the image.

14. The image forming apparatus according to claim 12, wherein for at least one of said plurality of exposing devices said defocusing means can shift said light emitting diode array to defocus the image.

15. The image forming apparatus according to claim 12, wherein for at least one of said plurality of exposing devices the defocusing means can shift the lens array to defocus the image.

* * * * *